United States Patent [19]

Amalfitano

[11] 3,986,215

[45] Oct. 19, 1976

[54] DETACHABLE TOILET SEAT FOR SMALL BOATS

[75] Inventor: Luigi Amalfitano, Staten Island, N.Y.

[73] Assignee: Lawrence Peska Associates, Inc., New York, N.Y. ; a part interest

[22] Filed: Oct. 31, 1974

[21] Appl. No.: 519,551

[52] U.S. Cl. ..... 4/110; 4/114; 4/116

[51] Int. Cl.[2] ..... E03D 13/00

[58] Field of Search ..... 4/1, 110, 116, 142, 4/141, 10, 112, 113, 237, 111

[56] References Cited

UNITED STATES PATENTS

| | | | |
|---|---|---|---|
| 363,846 | 5/1887 | Podgorski | 4/142 X |
| 3,063,061 | 11/1962 | Bertram | 4/134 |
| 3,327,324 | 6/1967 | Marsch | 4/111 |
| 3,435,464 | 4/1969 | Harding | 4/111 |
| 3,602,924 | 9/1971 | Kneisley | 4/142 |
| 3,829,908 | 8/1974 | Thomas | 4/1 |

*Primary Examiner*—Henry K. Artis

[57] ABSTRACT

A toilet sanitary device for use on small boats, which includes a frame carrying a toilet seat and extensible over the upper edge or gunwale of the boat over the water. An upright post carries a curtain ring from which is suspended a curtain somewhat like a shower bath curtain, and which is adjustable to cover the occupant of the toilet when in use. An angle strut is provided to connect from the outer portion of the toilet support frame and fits into a socket secured to a lower portion of the hull, to provide extra support for the toilet and its occupant.

6 Claims, 2 Drawing Figures

FIG. 1
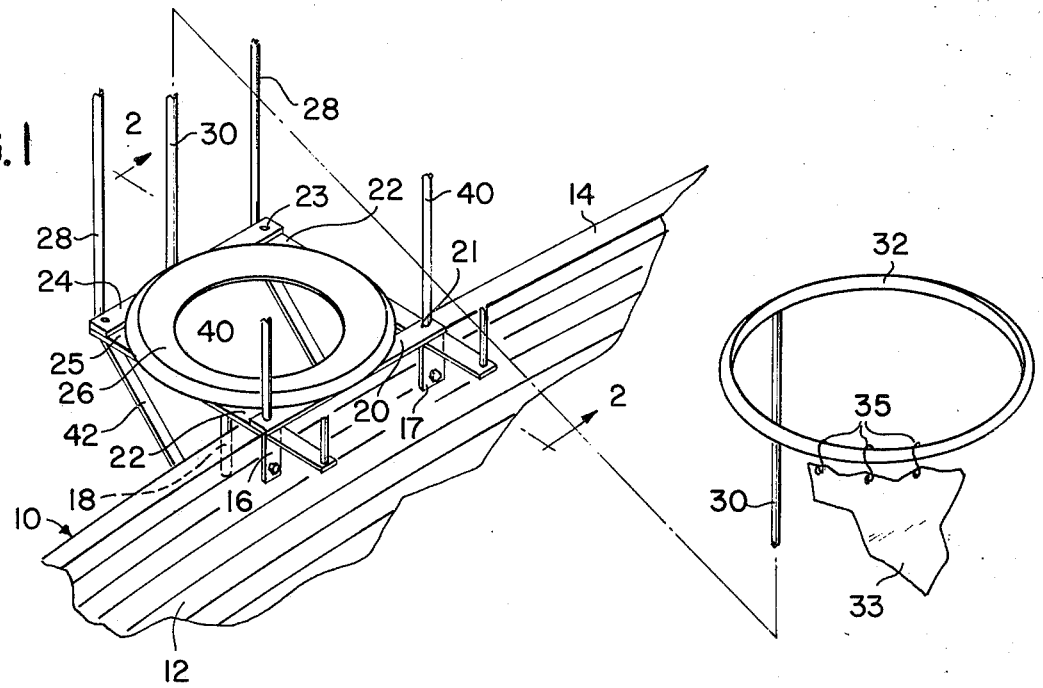
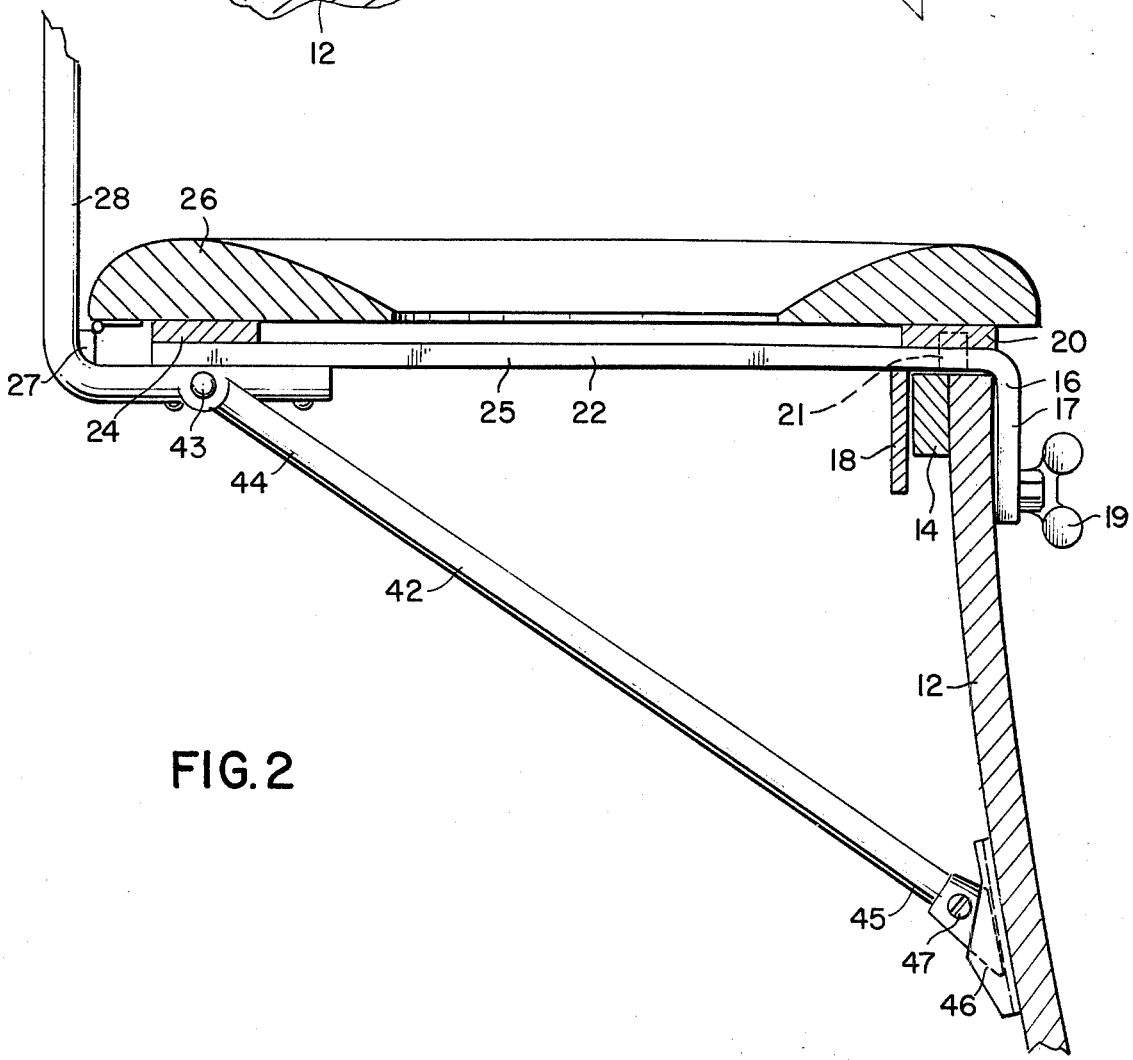
FIG. 2

DETACHABLE TOILET SEAT FOR SMALL BOATS

This invention relates to improvements in detachable toilet seats for small boats and the like.

An object of the invention is to provide a novel and improved toilet accommodation device for use on small boats and the like.

Another object of the invention is to provide a novel and improved toilet sanitary device which is easily mountable on small boats for use by the occupants or passengers for satisfying their personal toilet needs in privacy and in comfort.

A further object of the invention is to provide a novel and improved adjustable sanitary toilet device and accommodations therefor, in which there is a toilet seat supported on brackets for engaging the rub-rail of the boat, and for being extended inboard or outboard of the rub-rail, as needed, and which provides a curtained enclosure within which the user sits or stands, as desired, with reasonably adequate usual facilities of this type.

Still another object of the invention is to provide a novel and improved sanitary toilet combination device and enclosure for a user thereof, which includes a support for the toilet seat, toilet tissues for use as needed, and also an elevated framework for suspension of a fabric or plastic curtain all around the user for comfort in use of the device.

Still a further object of the invention is to provide a novel and improved sanitary toilet combination device and enclosure for use on small boats, which can be made and installed at low cost, either by hand workmanship or by mass production methods.

The above and other objects and advantages of the invention will become apparent from the following description of a preferred embodiment thereof, as illustrated in the accompanying drawings, forming a part hereof.

In the drawings:

FIG. 1 is a fragmentary perspective view of a portion of a small boat, with the toilet combination device secured over the rub-rail of the boat, and the curtain ring for suspending the privacy curtain being shown in spaced exploded array to the side of the view, with the curtain shown in fragment.

FIG. 2 is a sectional elevational view on a larger scale, taken substantially on Plane 2—2 of FIG. 1.

In connection with the ever-increasing uses of boats for recreation, fishing and exploration for sight seeing, one of the most present problems is that of the personal sanitation needs of the occupants of the boat, that is to say, going to the bathroom, where on the small boat, there is no bathroom. In many cases, women and girls are reluctant to go on a small boat, and justifiably so, for the obvious reasons of lack of privacy for this very essential need.

What then is to be done to solve this problem? The present invention seeks to furnish a solution, by providing a somewhat private toilet accommodation for those who go on small boats, which according to some Federal Regulations are held to be those under about thirty-five feet in length. This invention includes a framework which is attachable to the boat, either over the rub-rail or the gunwale, and has a toilet seat mounted thereon, and which is extensible out over the water or retractable back inwards as needed, and it has a privacy curtain somewhat like a showerbath curtain for extending around the user as desired.

In order to understand clearly the nature of the invention, and the best means for carrying it out, reference may be had to the drawings, in which like numerals denote similar parts throughout the several views.

As shown, there is a small boat 10, with its hull 12 surmounted by its rub-rail or gunwale 14. A U-shaped bracket 16 extends over the rub-rail 14, with one leg 17 extending over the inside of the gunwale, and the other leg 18 extending over the outside of the gunwale. A wingbolt 19 is threaded through the leg 17 of the bracket to tighten the grip of the bracket on the gunwale without use of tools.

As seen in FIG. 1, there is a cross bar 20 or rail which is bolted by bolts 21 at its two ends to the two brackets 16 to hold them in spaced relation. The brackets have rearwardly extending rails 22 which are in turn bolted by bolts 23 to a cross rail 24, so as to provide a rectangular platform 25 for the toilet seat 26.

A toilet seat hinge 27 is secured to the seat and to the strut 28 or other framework member such as the rear cross rail 24 to allow the seat to be lifted as needed. And also to hold the seat against dislodgement. The struts or posts 28 are secured firmly in place to prevent the user from falling backwards into the water. Another post 30 is also bolted to the rear cross rail 24 and extends upwardly to support the privacy curtain ring 32 from which the curtain 33 is suspended. The curtain is hung by curtain hooks 35 and can be easily swung open and closed like an ordinary shower curtain to enclose the user of the device, and is made long enough to completely enclose the user while in use.

To further aid the user there are also two upright front posts 40 bolted to the front rail 20 so the user can take hold in getting in and out of the toilet, and the curtain is arranged to extend outside of the posts 40. As a further aid, there are two angle struts 42 which are pinned by pins 43 to any member such as 28 at their rearward ends 44, and at their inner ends 45 are seated in sockets 46 which are secured to the outside of the hull by suitable marine glue or adhesives to avoid penetrating the hull from the outside. The sockets 46 may have set screws 47 to hold them firmly in place as needed. The mounting of the toilet seat will have two or more adjusting positions, to adjust for the size of the boat thickness on its rub-rail side.

It is thus seen that this invention provides a solution for a real lack of toilet facilities on small boats, and can be made at low cost, by hand or mass production.

It is understood that although the invention has been described in specific terms, various changes may be made in size, shape, materials and arrangement without departing from the spirit and scope of the invention as claimed.

Having thus described the invention, what is claimed as new is:

1. A toilet accommodation device for use on small boats and the like, comprising major support bracket means, boat engagement means carried by said bracket means for securing said bracket means to said boat, frame means carried by said bracket means for supporting a toilet seat fixture, toilet seat fixture means carried by said bracket means, and adjustable frame extension means for supporting said toilet seat fixture means both inboard and outboard of said boat.

2. The construction of claim 1, and wherein said major support bracket means comprises substantially U-shaped fixture means for extending over an upper edge portion of said boat hull, fastening means for securing said fixture means to said upper edge portion, outwardly extending rail means carried by said fixture means, and angularly oriented strut means secured at one end to said rail means and at its other end secured to a lower portion of said boat hull.

3. The construction of claim 2, and comprising socket means secured to said lower portion of said boat hull, for receiving said other end of said strut means, and strut fastening means for securing said strut to said socket means.

4. The construction of claim 3, and comprising upright frame posts carried by said frame means for providing hand grasp for the user of the device and to prevent falling out of said device.

5. The construction of claim 4, and comprising a support post carried by said frame means, a curtain ring member carried by said support post at an upper portion thereof, and a concealing curtain carried by said ring member for concealing a person while using said device, said concealing curtain being formed of flexible sheet material, and movable from open to closed positions as needed in use.

6. The construction of claim 5, and comprising toilet seat means carried on said frame means, and adjustably movable to adjust to the thickness of said upper edge portion of said boat hull, and hinge means engaging said toilet seat means to said frame means for tilting said seat means upwards and downwards.

* * * * *